US005851108A

United States Patent [19]

Clymer et al.

[11] Patent Number: 5,851,108

[45] Date of Patent: Dec. 22, 1998

[54] ELECTRONIC CONTROL SENSOR SYSTEMS

[75] Inventors: Mark Clymer, Mystic; Glenn Graves, Oakdale, both of Conn.

[73] Assignee: Beaudreau Electronics, Inc., Waterford, Conn.

[21] Appl. No.: 372,962

[22] Filed: Jan. 17, 1995

[51] Int. Cl.[6] ..... F04B 49/06

[52] U.S. Cl. ..... 417/44.1; 417/36; 222/40

[58] Field of Search ..... 417/9, 17, 36, 417/37, 44.1, 45; 73/290 R, DIG. 5; 200/84 C; 137/392; 222/40, 3, 41

[56] References Cited

U.S. PATENT DOCUMENTS

| | | | |
|---|---|---|---|
| 4,842,163 | 6/1989 | Bravo | 222/40 |
| 4,971,225 | 11/1990 | Bravo et al. | 222/110 |
| 4,979,122 | 12/1990 | Davis et al. | 364/483 |
| 5,048,552 | 9/1991 | Bourne | 137/351 |
| 5,091,716 | 2/1992 | Nelson et al. | 340/605 |
| 5,100,024 | 3/1992 | Bravo | 222/40 |
| 5,349,994 | 9/1994 | Koeninger | 137/351 |
| 5,351,036 | 9/1994 | Brown et al. | 340/618 |
| 5,360,033 | 11/1994 | Williams et al. | 417/36 |
| 5,414,742 | 5/1995 | Hornak et al. | 376/251 |

OTHER PUBLICATIONS

Beaudreau Electronics, Inc. Product Brochure, Model 404, Pump Cut–Off Unk Date.

*Primary Examiner*—Meng-Al T. An
*Assistant Examiner*—Xuan M. Thai
*Attorney, Agent, or Firm*—Fliesler, Dubb, Meyer & Lovejoy

[57] ABSTRACT

A motion sensor for connecting to the housing of a gasoline dispenser which is used to dispense gasoline to vehicles. The motion sensor includes components to detect motion, such as that caused by a vehicle striking the dispenser housing, and provides a signal to a controller which cuts off electrical power through an electrical supply line to electrical components of the dispenser. With power disconnected from electrical components of the dispenser, potential arcing of electricity to those electrical components when they become damaged, or potential arcing when the electrical supply line becomes damaged can be prevented to potentially prevent a resulting fire or explosion.

6 Claims, 15 Drawing Sheets

404A Controller wired for 110 Vac, to be used with a 408 probe.

* Provides a Simple Modification for Converting Magnetic/Float System into an Optical/Isolated Solid State System (Current Sensor)

Current through the AC line generates a magnetic field (H) about the peremeter of the wire. The MR-Bridge modulates via the current i generating a voltage change on the output of the MR-Bridge.

ELECTRONIC CONTROL SENSOR SYSTEMS

DESCRIPTION

1. Field of the Invention

The present invention relates to sensors and sensor systems that are responsive to environmental conditions that are present at a site and are useful for providing a warning and/or shutting off power to equipment at the site. In particular, the sensors and sensor systems of the invention are useful for shutting off electric power at a site, for example, shutting off power to pumps that are used for transporting or dispensing liquid petrochemicals (such as gasoline) or other liquid chemicals. In certain situations, the invention is applicable to fluids (including gases and liquids) in general.

2. Background of the Invention

There are a variety of situations in which it is desirable to be able to detect certain environmental conditions that are present at a site and to be able to control the flow of a chemical such as petrochemicals in response to such conditions. One example is in gasoline or petrochemical pumps. There, because of the extreme flammability and the great potential for ecological damage that stems from the spilling or burning of gas or petrochemicals, it is highly desirable to be able to shut off the flow of gasoline or the power to pumps pumping the same so as to avoid spills or burning.

An attempt to design a system to address these problems is disclosed in U.S. Pat. Nos. 4,971,225, 4,842,163, and 5,100,024 all to Bravo (the disclosures of which are hereby incorporated by reference in their entirety). In such patents a system for collecting gasoline in a well under a gasoline pump is described. The well has a liquid level sensor included therein which is mechanically interlinked to a gasoline pump shear valve so that when the level of a liquid in the well exceeds a predetermined depth, the shear valve in the pump is actuated and flow to the pump is ceased.

However, the Bravo system is a relatively cumbersome and inefficient system for shutting off flow of gasoline. Its level sensor for example operates in a manner similar to a toilet bowl float system. Moreover, through the fact of mechanical interaction between the float mechanism and the shear valve, there is a significant chance that the shear valve will not be actuated. More fundamentally, the Bravo system does not describe any mechanism for alerting a pump operator that the liquid level has exceeded the threshold. All that occurs is that the pump will no longer operate.

In addition to these shortcomings of the Bravo system, there are a variety of other environmental conditions in a pump that are important to consider. For example one of the highest risks of fire associated with gasoline pumps is motor vehicle impact with the dispenser. In some situations such impacts trigger the shear valve in the pump line, however, not in every situation. In Bravo in the event that the shear valve is not triggered by the impact of a vehicle, gasoline will freely flow until the liquid level in the dispenser in the well below the pump fills to the threshold level and trips the shear valve. However, as was mentioned above, the float system and mechanical interrelation between the level sensor and the shear valve in the Bravo system represents unartful science, at best.

In a similar manner, large ground motions, such as those from earthquakes, may cause a supply line rupture and spillage of fuel from gasoline pumps. In such situations, again, the Bravo system will only detect such defect in the event that the gasoline spills into the well below the pump and triggers the level sensor float mechanism. The Bravo system shuts off only the flow of gasoline through the shear valve. It does not shut off power. Therefore, if gasoline is being spilled from another location (i.e., below the shear valve), the power in the pump could still result in a fire.

Similar problems exist in the transport or dispensing of a variety of fluids, including liquid chemicals. Many chemicals pose fire risks and/or ecological problems if spilled or released from conduits or lines. Aside from improper disposal of chemicals, chemical spills or releases are among the leading causes of ground water contamination. In addition, many fires at chemical plants and chemical refinery, transportation, and dispensing facilities are caused do to leaks and/or accumulation of chemicals below pumps or conduits or the release of chemicals.

Accordingly, there is a need in the art to provide sensor based control systems which are responsive to environmental conditions at or around pumps and/or conduits carrying chemicals in order to avoid the risk of fire and/or ecological injury that is associated with the release or spilling of petrochemicals and other chemicals.

SUMMARY OF THE INVENTION

In accordance with a first aspect of the present invention, there is provided a liquid chemical spill control system, comprising: a receptacle positioned below a conduit in which the liquid chemical is being pumped with an electrical pump, the pump being powered by a power supply, the receptacle comprising a base and being adapted to collect a quantity of the liquid chemical, a liquid level sensor disposed in the base of the receptacle, the liquid level sensor being designed to produce a first signal to the pump upon the detection of a predetermined quantity of the liquid chemical, the signal causing the pump to substantially stop drawing power through the electrical line, and a power sensor in communication with the power supply to detect when the pump substantially stops drawing power, the power sensor adapted to provide a signal to alert an operator that the pump has substantially stopped drawing power from the power supply.

In a preferred embodiment, the liquid level sensor comprises a radiation emitter and a radiation detector, the emitter emitting a type of radiation along a path that is detected by the detector, the detector producing a third signal in response to detecting the radiation, and wherein when the quantity of the liquid chemical is collected the liquid chemical alters the path of the radiation the emitter and the detector and the detector produces the first signal in response thereto. In another preferred embodiment, the liquid level sensor comprises a housing having a wall, an open end, and a closed end defining a chamber, the chamber having a flexible membrane bound therein in proximity to the closed end, the membrane having a magnet bound thereto, the closed end having a magnetic sensor bound thereto, wherein when the quantity of the liquid chemical is collected the liquid chemical is communicated against the open end and forms a head of pressure within the chamber pressing against the membrane and causing the membrane to be flexed toward the closed end which causes the magnet to be moved in closer proximity to the sensor thereby producing the first signal. In another preferred embodiment, the liquid level sensor comprises a housing having a wall, an open end, and a substantially closed end defining a chamber, the chamber having a float disposed therein, the float having a top end and a bottom end and a magnet bound to the top end, the closed end having a magnetic sensor bound thereto, wherein when the quantity of the liquid chemical is collected the liquid chemical is communicated into the open end causing the float to be moved toward the closed end which causes the magnet to be moved in proximity to the sensor thereby producing the first signal. In another preferred embodiment, the system further comprises a motion sensor that is in electrical communication with the pump, the motion sensor being adapted to detect motion of the conduit and to produce a second signal to the pump upon detecting a predetermined quantity of motion in the conduit, the signal causing the pump to substantially stop drawing power through the electrical line. In another preferred embodiment, the motion sensor comprises a housing having a first end and a second end with a levitating magnet disposed at the first end and a magnetic sensor disposed at the second end and having a levitated magnet being disposed therebetween, wherein, upon a predetermined quantity of motion in the conduit, the levitated magnet moves in proximity to the magnetic sensor and produces the second signal. In another preferred embodiment, the motion sensor further comprises a ferrous latching plate disposed at the second end and wherein when the levitated magnet moves in proximity to the magnetic sensor the levitated magnet latches to the latching plate. In another preferred embodiment, the power sensor is an amp probe.

In accordance with a second aspect of the present invention, there is provided a liquid chemical spill control system, comprising: a receptacle positioned below a conduit in which the liquid chemical is being pumped with an electrical pump, the pump being powered by a power supply, the receptacle comprising a base and being adapted to collect a quantity of the liquid chemical, and a motion sensor that is in electrical communication with the pump, the motion sensor being adapted to detect motion of conduit and to produce a first signal to the pump upon detecting a predetermined quantity of motion in the conduit, the first signal causing the pump to substantially stop drawing power through from the power supply.

In a preferred embodiment, the motion sensor comprises a housing having a first end and a second end with a levitating magnet disposed at the first end and a magnetic sensor disposed at the second end and having a levitated magnet disposed therebetween, wherein, upon a predetermined quantity of motion in the conduit, the levitated magnet moves in relation to the magnetic sensor and produces the first signal. In another preferred embodiment, the motion sensor further comprises a ferrous latching plate disposed at the second end and wherein when the levitated magnet moves in proximity to the magnetic sensor the levitated magnet latches to the latching plate. In another preferred embodiment, the system further comprises a liquid level sensor disposed in the base of the receptacle, the liquid level sensor being designed to produce a second signal to the pump upon the detection of a predetermined quantity of the liquid chemical, the second signal causing the pump to substantially stop drawing power through the electrical line. In another preferred embodiment, the liquid level sensor comprises a radiation emitter and a radiation detector, the emitter emitting a type of radiation that along a path that is detected by the detector, the detector producing a third signal in response thereto, and wherein when the quantity of the liquid chemical is collected the liquid chemical blocks the path between the emitter and the detector, and the detector produces the second signal in response thereto. In another preferred embodiment, the liquid level sensor comprises a housing having a wall, an open end, and a closed end defining a chamber, the chamber having a flexible membrane bound therein in proximity to the closed end, the membrane having a magnet bound thereto, the closed end having a magnetic sensor bound thereto, wherein when the quantity of the liquid chemical is collected the liquid chemical is communicated against the open end and forms a head of pressure within the chamber pressing against the membrane and causing the membrane to be flexed toward the closed end which causes the magnet to be moved in closer proximity to the sensor thereby producing the second signal. In another preferred embodiment, the liquid level sensor comprises a housing having a wall, an open end, and a substantially closed end defining a chamber, the chamber having a float disposed therein, the float having a top end and a bottom end and a magnet bound to the top end, the closed end having a magnetic sensor bound thereto, wherein when the quantity of the liquid chemical is collected the liquid chemical is communicated into the open end causing the float to be moved toward the closed end which causes the magnet to be moved in proximity to the sensor thereby producing the second signal. In another preferred embodiment, the system further comprises a power sensor in electrical communication with the electrical line powering the pump, the power sensor being in communication with an alarm for alerting an operator that the pump has stopped drawing power through the electrical line. In another preferred embodiment, the power sensor is an amp probe.

In accordance with a third aspect of the present invention, there is provided a motion sensor, comprising: a housing having a first end and a second end with a levitating magnet disposed at the first end and a magnetic sensor disposed at the second end and having a levitated magnet being disposed therebetween, wherein movements of the levitated magnet relative to the levitating magnet are detected by the magnetic sensor.

In a preferred embodiment, the motion sensor further comprises a ferrous latching plate disposed at the second end and wherein when the levitated magnet moves in proximity to the magnetic sensor the levitated magnet latches to the latching plate. In another preferred embodiment, the magnetic sensor comprises a Hall effect integrated circuit.

In accordance with a fourth aspect of the present invention, there is provided a fluid pressure sensor, comprising: a housing having a wall, an open end, and a closed end defining a chamber, the chamber having a flexible membrane bound therein in proximity to the closed end, the membrane having a magnet bound thereto, the closed end having a magnetic sensor bound thereto, wherein when a fluid pressure is exerted through the open end and into the membrane is flexed toward the closed end which causes the magnet to be moved in closer proximity to the sensor thereby producing a variable signal from the sensor dependent upon the proximity of the magnet to the sensor.

In accordance with a fifth aspect of the present invention, there is provided a liquid level sensor, comprising: a housing having a wall, an open end, and a substantially closed end defining a chamber, the chamber having a float disposed therein, the float having a top end and a bottom end and a magnet bound to the top end, the closed end having a magnetic sensor bound thereto, wherein when a liquid fills the chamber the float is moved toward the closed end which causes the magnet to be moved in proximity to the sensor thereby producing a variable signal from the sensor dependent upon the proximity of the magnet to the sensor.

In accordance with a sixth aspect of the present invention, there is provided a liquid level sensor, comprising: a housing having an substantially open bottom end and a substantially closed top end including a vent defining a chamber, the top end having a prism dectector assembly attached thereto, the prism detector having a prism with a top side, a first wall, and a second wall and having a light source and a light detector directed through the top side of the prism, wherein a first signal is produced by the detector when light emitted by the light source is efficiently reflected off of the first and second walls when the first and second wall are in contact with a first fluid and a second signal is produced when light emitted by the light source is not efficiently reflected off of the first and second walls when the first and second wall are in contact with a second fluid.

BRIEF DESCRIPTION OF DRAWING FIGURES

FIG. 1 is a schematic representation of a gasoline pump control system in accordance with the present invention including a motion sensor and a liquid level sensor, each of which are in communication with a controller which is in electrical communication with the pump. Upon triggering either the motion sensor or the liquid level sensor power to the pump is shut off by the controller. The power supply line to the controller is monitored by a power sensor which upon the reduction of power to the pump below a threshold amount results in an alarm state.

FIG. 1*a* a schematic representation of a gasoline pump control system in accordance with the present invention and as shown in FIG. 1 showing a controller additionally comprising a four way explosion proof connector housing and a relay.

FIG. 1*b* depicts a preferred circuit diagram for use in the controller and relay as shown in FIG. 1*a*.

FIG. 2 is a side view of a level sensor in accordance with the present invention.

FIG. 2*a* is a side view of another level sensor incorporating a prism in accordance with the present invention.

FIG. 2*b* is a blown up view of the operation of the prism in accordance with the embodiment shown in FIG. 2*a*.

FIG. 2*c* is a schematic representation of a circuit for controlling the liquid level sensor of the present invention.

FIG. 3 is a side cross-sectional view of another liquid level sensor in accordance with the present invention.

FIG. 4 is another side cross-sectional view of a liquid level sensor in accordance with the present invention.

DETAILED DESCRIPTION OF THE PREFERRED EMBODIMENTS

Figure 1:
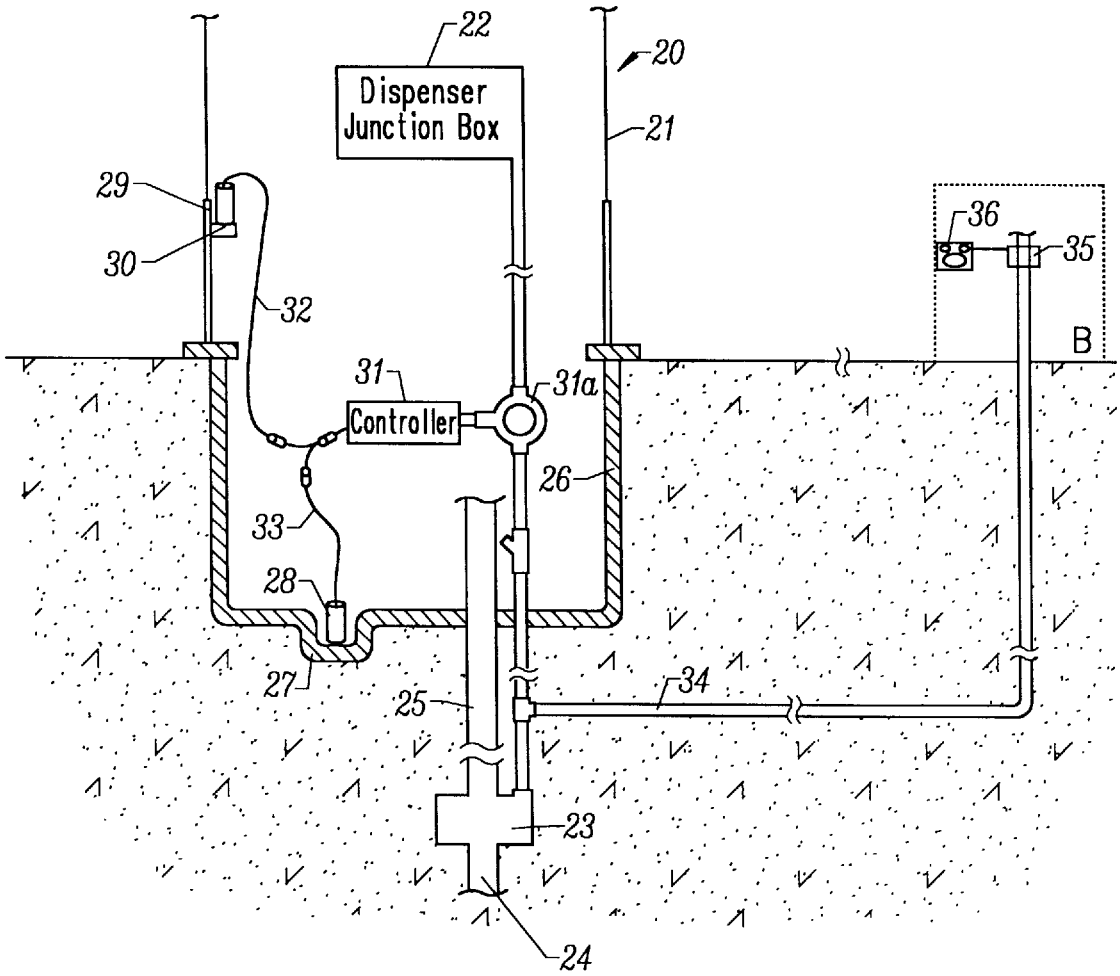

In accordance with the present invention there are provided electronic power shutoff sensor systems. In one embodiment of the present invention, such sensor systems are designed and used to stop the flow of electricity to a pump that is pumping a liquid chemical through a conduit. In a particular embodiment of the invention such systems are provided in electrical communication with gasoline or other petrochemical dispenser pumps and are used to shut off power to the pump that is pumping the gasoline or other petrochemical. In this way, a spill can be prevented from starting or expanding. Moreover, preferably, an operator is alerted to the shut off of the pump through an alarm, which can be either audible or visible.

An alternative system, for example, includes a motion sensor and a liquid level sensor each of which are electrically connected to a controller which is adapted to shut off the power to the pump. In other embodiments, the motion sensor is designed to monitor for motion in the pump, such as motion derived from the impact of a vehicle or other object and/or ground motions from an earthquake. The motion sensor in one embodiment can be designed to give a signal in the event of side-to-side, up-down, and/or tilting motions. A side-to-side motion could be associated with the impact of a vehicle. An up-down motion could be associated with ground motions from an earthquake. And tilting motions can be associated with impacts or harmonic oscillations from an earthquake. The motion sensor of the invention is designed so that it produces signals upon the occurrence of a threshold amount of motion. Thus, a minor bump or a small earthquake will not result in the pump being shut off. The amount of force or motion required can be preset into the motion sensor. Or, alternatively, the signal can be processed by a controller which can be preset or programmed to shut off power upon the occurrence of a given signal.

In many applications of the present invention, liquid level sensors in accordance with the invention are ordinarily positioned in a well or sump below a conduit and/or a pump which is used to pump the chemical, such as gasoline, where the chemical, if spilled, will collect. In another embodiment, the liquid level sensor is designed to produce a signal when the amount of liquid collected exceeds a certain threshold. Thus, collection of a minor amount of the chemical or another liquid, such as water, will not cause a signal to be produced. However, where the amount of liquid collected exceeds the threshold amount, a signal will be sent to a controller which will then shut off power to the pump.

In order to monitor when the power is shut off due to either the occurrence of an impact or motion that exceeds the predetermined threshold or the collection of liquid in excess of a predetermined amount, in still another embodiment, the invention includes a power sensor that monitors the power line that runs from a gas station or pumping station to the pump. The sensor is capable of determining if the power is shut off or goes below a certain threshold amount. In a gas station, ordinarily, there are a plurality of pumps and/or dispensers from which a consumer can pump gasoline. In most situations, each of the pumps at the individual dispensers include a separate power lead which provides the electricity for operating the pump. Even when not pumping, such pumps still draw a current through the power lead. This current is referred to herein as a resting load or current. Such resting load can be monitored through use of a device called an amp probe.

The amp probe operates as a power sensor in accordance with the present invention. Accordingly, it is possible to monitor when the current goes below the resting load, for example, when the power to the pump is shut off due to a triggering of either the motion sensor or the liquid level sensor. The power sensor can be linked to an alarm, such as a flashing light or a audio signal, to inform the gas or pumping station attendant that a pump has either leaked or suffered an impact.

In such embodiment, the power sensor is highly advantageous because it is not necessary to run separate wiring to each pump in order to monitor each of the pumps. This results in a substantial cost and time savings to gasoline stations. For example they do not need to perform any major construction such as tearing up the filling area to install new electrical lines. Moreover, the gas station attendant is informed instantly which particular pump has been shut off and can take appropriate measures to ensure safety and/or minimize ecological impact.

As will be appreciated, the combination of a liquid level sensor and a motion sensor represent a huge advance in safety. Impacts or ground motions can often cause leaks in conduits carrying chemicals or damage pumps propelling such chemicals through conduits. Therefore, the motion sensor will act to shut off the power to the pump as an insurance measure to allow the conduits and pumps to be inspected, often, prior to any of the chemical spilling. The liquid level sensor will be available to sense leaks that are not related to impacts or ground motions, leaks that are caused by impacts or ground motions that are too minor to trigger the motion sensor, or leaks that are caused by impacts or ground motions that are not sensed by the motion sensor because of a failure of the motion sensor to respond.

However, as will also be appreciated, the combination of a motion sensor and a liquid level sensor will not be necessary in every situation. For example, in certain situations it will be neither desirable nor convenient to attempt to collect a chemical below a conduit so that the liquid level can be measured. An example might be in a refinery where supply lines intermingle or run many stories and it would be difficult to collect a liquid or if a liquid were collected it would be difficult to know its source. Another example could be where a gas is being carried by a conduit; it would be difficult to collect and detect the gas. In such situations, an operator would desire a system that would alert him or her to the possibility of a leak. This can be accomplished with the motion sensors of the invention.

Similarly, not every situation will call for the monitoring of motions. An example is where the conduit and/or pump is located in an isolated area and/or in an area that is not prone to ground motions. In such situations, and where the chemical is a liquid, some measure of safety may be obtained through use of the liquid level sensor systems in accordance with the invention.

Operators of facilities in which fluid chemicals are pumped through conduits are able to tailor use of the sensor systems of the invention to minimize their risk of chemical leaks, release, fire, and/or ecological damage.

I. GASOLINE PUMP SHUT-OFF CONTROL SYSTEMS

One of the immediate needs that is addressed in accordance with the invention is the provision of an inexpensive, efficient, and effective system to minimize the risk of gasoline leaks that is faced by gas station operators. It will be understood that gas stations pose enormous environmental or ecological risk as well as great fire risks. Moreover, due to the proximity of many such stations to people, the risk is only amplified. Through the present invention, such risks can be dramatically reduced when a gas station installs a sensor system in accordance with the invention.

In yet another embodiment, the system includes a liquid level sensor, a motion sensor, and a remote power sensor. Accordingly, leaks from the dispensers can be detected by a liquid level sensor. Impacts (and often leaks before they magnify) can be detected by a motion sensor. And, the gas station attendant is alerted to the detection of either of these conditions with an alarm and in sufficient time for him or her to take protective measures.

Such a system is now described in detail with reference to FIG. 1, which provides a schematic view of the electronic shutoff sensor system of an embodiment of the present invention as deployed in a gasoline station. There, a gasoline dispenser 20, which is a conventional dispenser of the type used by millions of people on a daily basis, includes a housing 21 and a junction box 22. The junction box 22 is ordinarily in communication with the pump 23 and keeps track of the amount of liquid flowing through the pump 23 as well as determining the price of the liquid that a consumer pumps through the hose (not shown). The liquid is supplied to the pump 23 through pump supply line 24 and from the pump 23 into the dispenser 20 through dispenser line 25. In another embodiment, the dispenser 20 sits above a dispenser pan 26 which is ordinarily inset in the ground (shaded area). The dispenser pan is typically manufactured from a non-corrosive material and/or lined with a non-corrosive material. The purpose of a dispenser pan 26 is to collect any liquid that drips from the dispenser 20 or the line 25 or elsewhere and collects it so that it does not run out into the soil to prevent ground water contamination. A majority of pumps in current operation already have dispenser pans 26.

A sump or well is typically provided in the dispenser pan 26 to act as a collection point for any liquid that has leaked and will be referred to as the collection point 27. The desirability of the collection point 27 is obvious. It allows a smaller volume of liquid to be collected before detection is possible. If the entire dispenser pan was used as the collecting point 27 a large volume of liquid would have to collect. This is undesirable since it may increase the risk of fire. While it is preferred that the collection point 27 includes a sump or well type of configuration, it may also be a sloped floor in the dispenser pan 26 or any arrangement that allows for the collection of a smaller volume of liquid in a greater depth than is possible in the full cross-section of the dispenser pan 26.

Where an existing dispenser pan 26 in a gas station being retrofitted with liquid level sensor systems in accordance with the invention does not contain a collection point 27, as will be appreciated, it is often possible to modify the dispenser pan 26 to include one. For example, a prefitted solid or molded object having a collection point 27 formed therein could be fitted and affixed (either mechanically or by its own weight) into the base of the dispenser pan 26. This object would act like the base of the dispenser pan 26 and any liquid that leaked therein would fill at the collection point 27 allowing detection.

At the collection point 27 in the dispenser pan 26, in one embodiment, a liquid level sensor 28 is disposed. The liquid level sensor 28 is designed to monitor the depth of liquid that may have collected at the collection point 27 and to provide a signal when the depth of liquid at the collection point exceeds a predetermined threshold amount.

On a wall 29 of the dispenser 20, a motion sensor 30 is also provided. The motion sensor 30 is designed to provide a signal upon the occurrence of a certain minimum impact such as impact from a vehicle or ground motion from an earthquake.

A controller 31 is provided in electrical communication with each of the motion sensor 30 and the liquid level sensor 28 through leads 32 and 33 respectively. The controller 31 comprises a circuit that shuts off power to the pump 23. The power supply runs through supply line 34 to the pump 23 run through the controller 31, including an explosion proof connector housing 31*a* (i.e., an explosion proof cross such as a GUAX-100, ordinarily, from the gas station (depicted by B) and referred to as a remote station (B). At the remote station B, a power sensor is placed in communication with the supply line 32. The power sensor 35 is ordinarily placed in communication with an alarm circuit 36 that will flash a light or sound an alarm or to otherwise act as an alarm in the event of a shut down of power by the controller 31 in response to an impact as detected by the motion sensor 30 or the release of liquid as determined by the liquid level sensor 28.

Figure 1A:
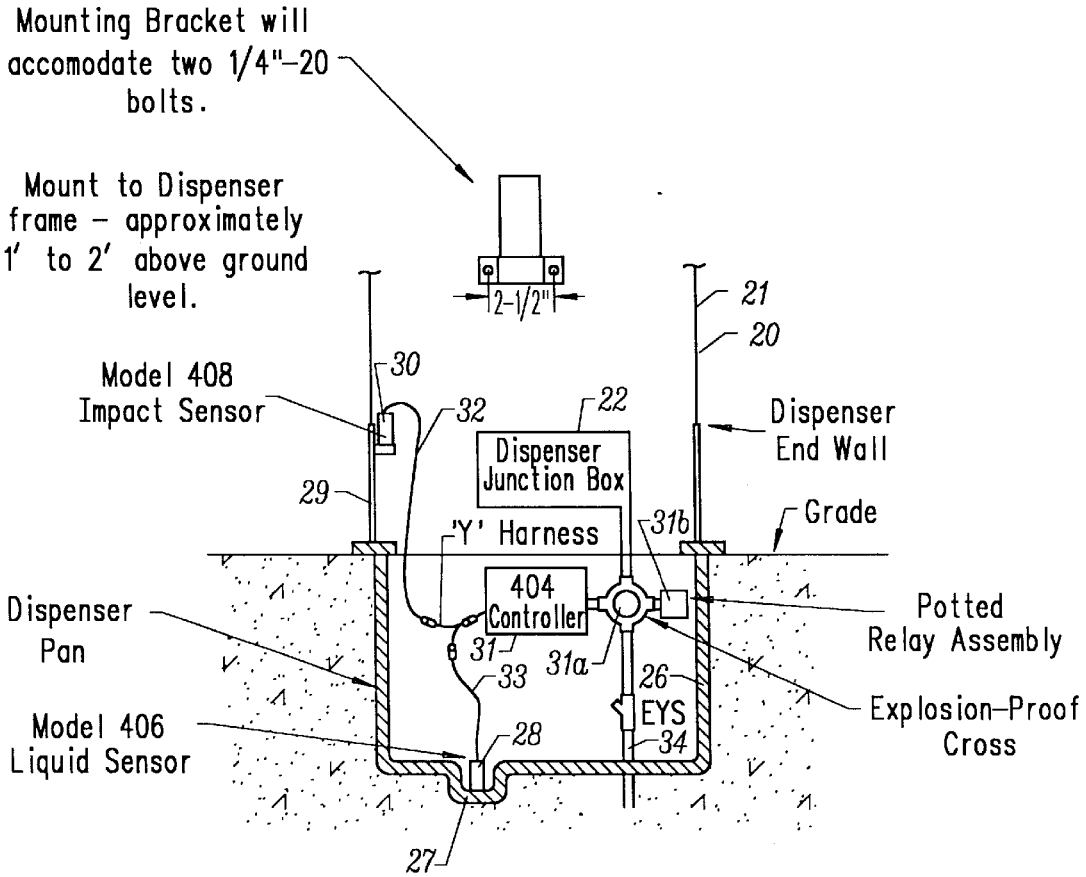
Figure 1B:
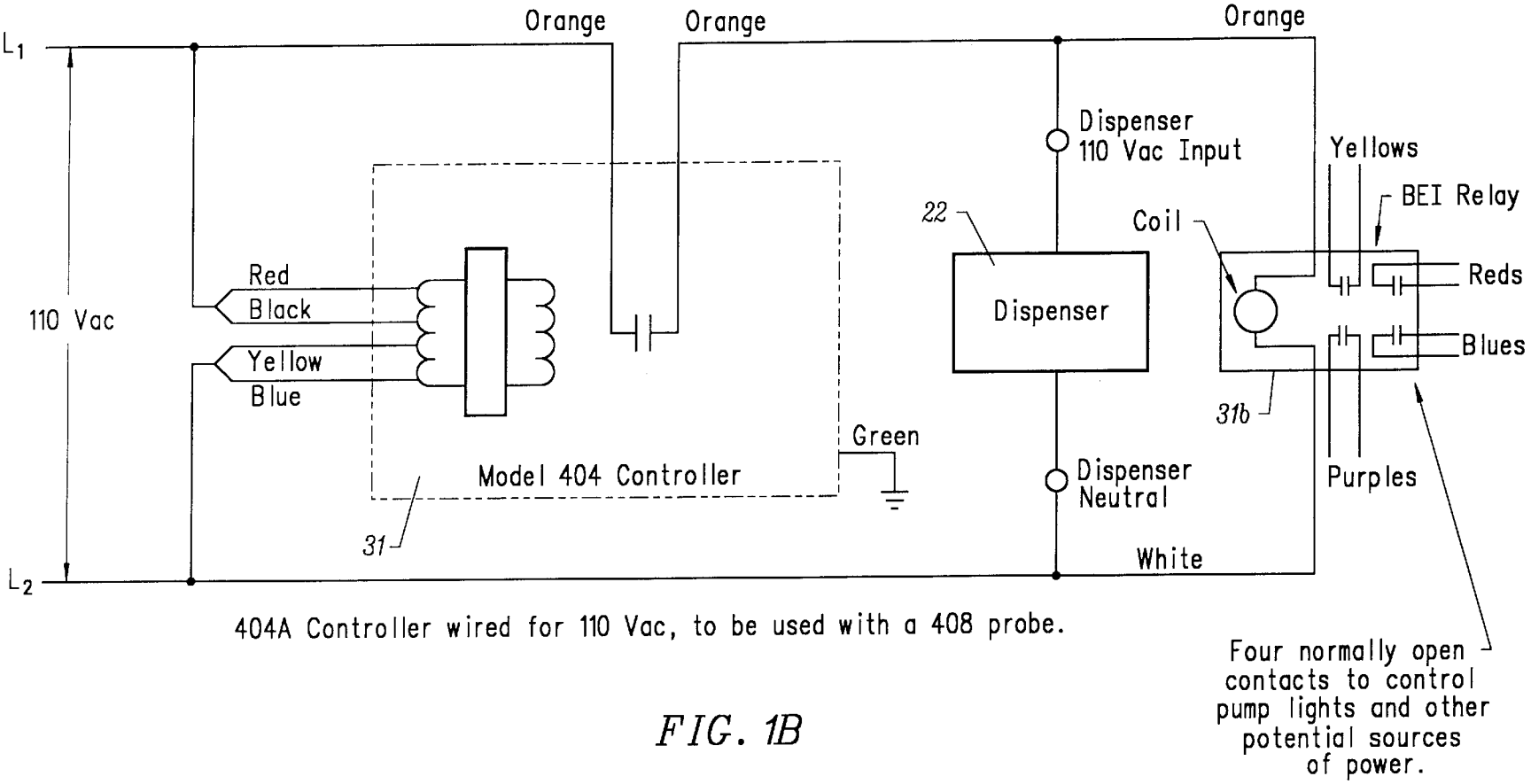

As shown in FIG. 1*a*, the explosion proof connector housing 31*a* of the controller 31 may additionally comprise a relay 31*b* which is in electrical communication with the controller 31. The relay 31*b* is generally an explosion proof potted relay assembly which can contain additional contacts that can be shut down by the controller upon, for example, detection of liquid by the liquid level sensor 28 or detection of movement from the impact sensor 30. In the embodiment illustrated in FIG. 1*b*, the relay 31*b* provides four additional contacts that can be connected with other possible hot leads in the pump, such as pump light leads, and the like.

As will be appreciated, in a variety of situations it will be advantageous to include both a liquid level sensor and a motion sensor. However, in certain other situations it is preferable to utilize only one or the other. For example, where a customer already has a liquid level sensor, he or she may only require only a motion sensor. Or, alternatively, in pumping situations when the risk of impact is low or earthquakes are improbable, a motion sensor may not be necessary. Moreover, it is also possible to retrofit existing systems with any one of the motion sensor, the liquid level sensor, or the power sensor.

Preferred sensors and sensor systems will now be described in greater detail.

II. LIQUID LEVEL SENSORS

While the liquid level sensor could be virtually any sensor that is capable of measuring or detecting a quantity or volume of a liquid, it is preferable that the sensor be an electronic sensor. This allows the sensor to more effectively interact with the pump or the controller in order to shut off power to the pump and avoids the possibility of mechanical failure that is associated with mechanical systems, such as the Bravo system.

Figure 2:
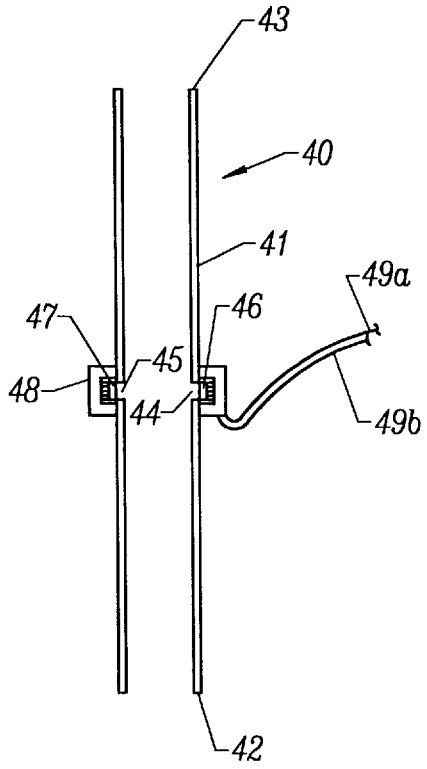

Referring now to FIG. 2, there is provided a side view of a one embodiment of a liquid level sensor in accordance with the present invention. The liquid level sensor 40 in this embodiment, includes an elongate tubular housing 41 having an open bottom end 42 and an open top end 43. The tube 41 includes transparent windows 44 and 45 on opposite sides of the tube 41 that are positioned to allow light emitted by a light emitting diode ("LED") 46 to be detected by a detector 47 that are mounted on the tube 41 with an annular ring 48 that includes appropriate input and output connectors which are fed through leads 49*a* and 49*b*.

While an LED produces visible radiation, it will be understood that other forms of radiation can also be used. One common example is infra red radiation. However, as will be appreciated, where infra red radiation is used, the system most be modulated which increases complexity and cost of the system. In situations where other forms of radiation are used, the windows 44 and 45 should be manufactured from a material that is transparent to the form of radiation. Further, it will be appreciated that it is very easy to substitute the two windows 44 and 45 for a single window and to utilize a reflector on the side wall of the tube opposite the window. In such a situation, a separate emitter and detector can still be used. Or, alternatively, there are single emitter/detector systems which are commercially available.

Figure 2A:
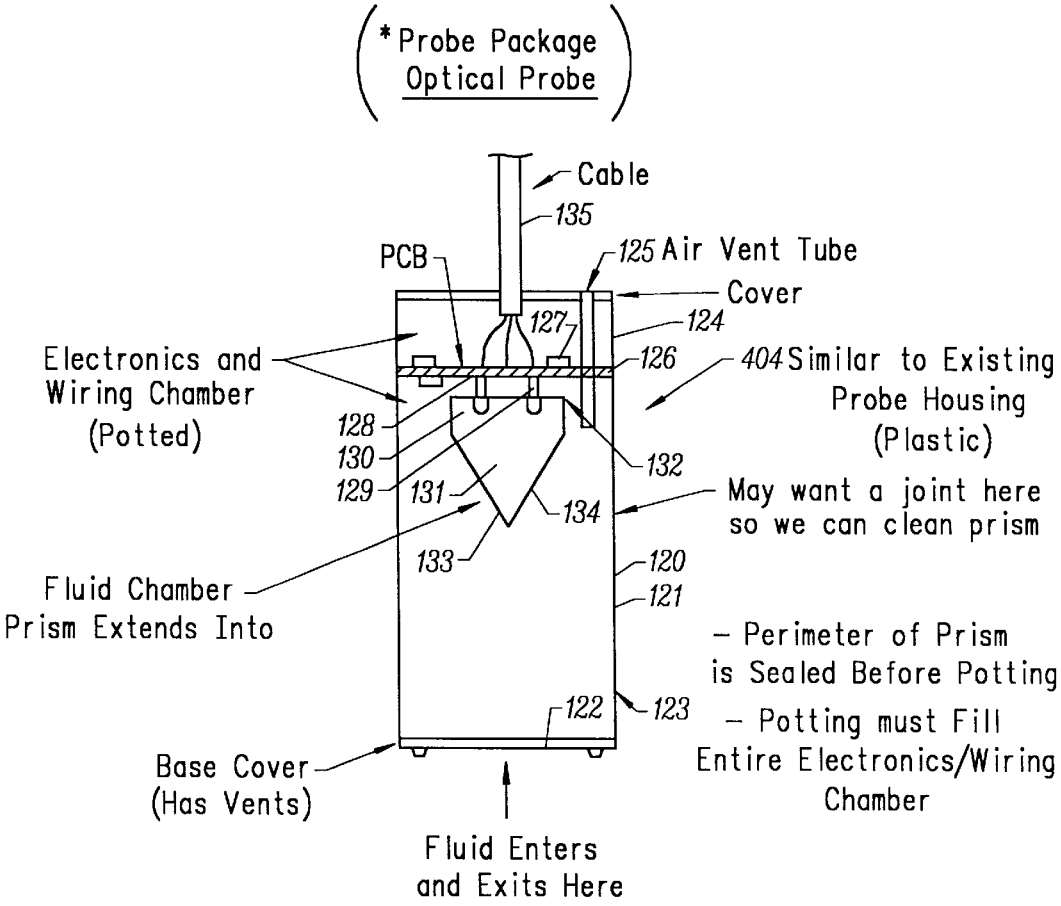
Figure 2B:
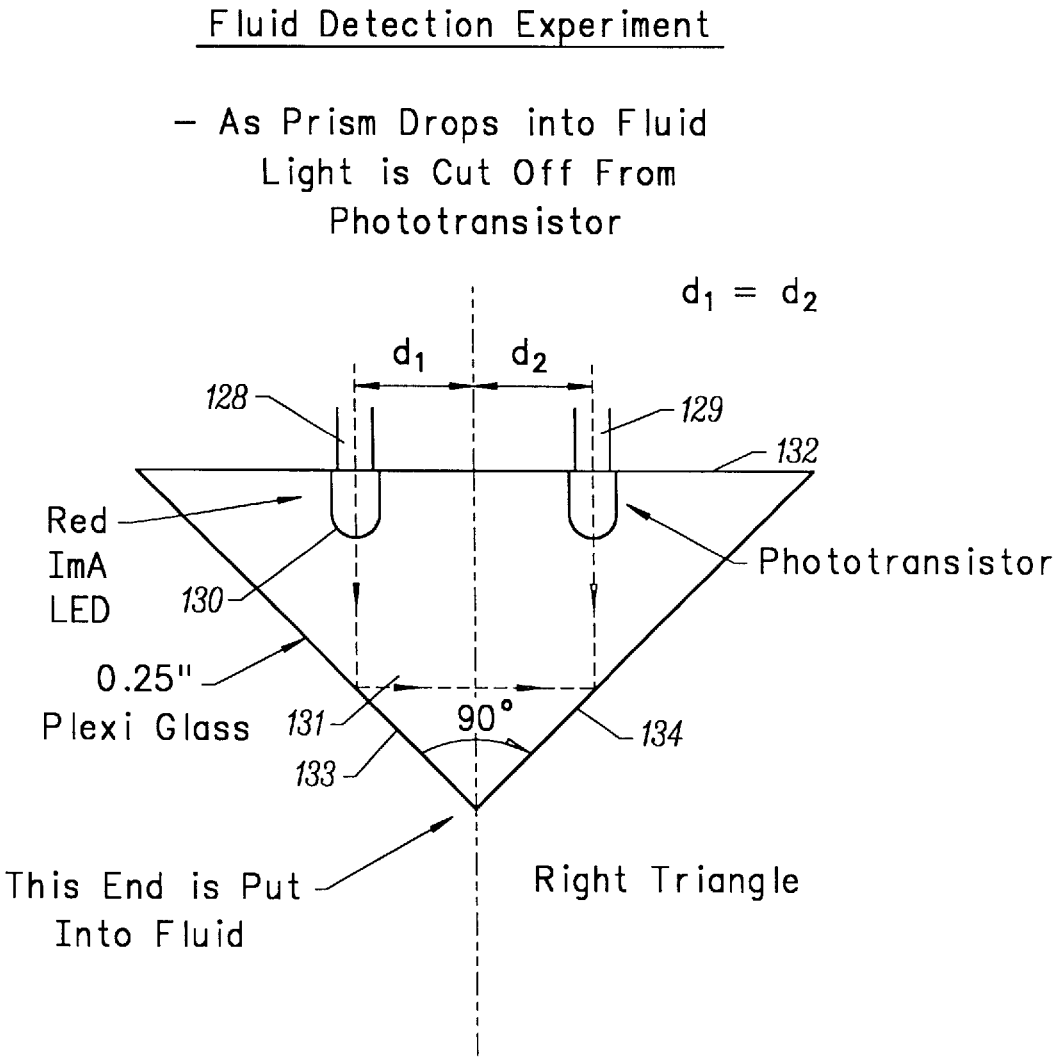

As will be appreciated, when no liquid fills the tube 41, the signal between the LED 46 and the detector 47 is unobstructed. However, when liquid fills the tube 41, the signal between the LED 46 and the detector 47 will be obscured. This change in signal can be used to force the controller (FIG. 1; 31) to shut off power to the pump (FIG. 1; 23). As will be understood, a significant limitation on the above-described liquid level sensor is that the contrast ratio between many liquids (such as fuel) and air is very low which reduces the reliability of the system. Accordingly, the following embodiment is provided which does not suffer from the above-difficulty. As shown in FIG. 2*a*, an alternative liquid level sensor is provided. The liquid level sensor 120 includes a housing 121 having a vented base 122 on a lower end 123. The housing 121 also includes an upper end 124, which is vented through vent hole 125. Such vent will allow any liquid collecting in the collection point (FIG. 1; 27) to be communicated into the housing as described below.

Also on the upper end 124, a potted electronic assembly 126 is included. The electronic assembly includes a simple circuit board 127 having an LED 128 and a phototransistor 129 and supporting circuitry. The LED 128 and the phototransistor 129 are deployed within a top end 130 of a prism 131 (i.e., a plexiglass prism) having a top side 132 and a first wall 133 and a second wall 134. As will be appreciated, this arrangement allows a certain amount of light from the LED 128 to reflect off the first wall 133 to the second wall 134 and from the second wall up towards, and be detected by, the phototransistor 129. Power and output leads are supplied to the circuit board 127, the LED 128, and the phototransistor 129 through a cable 135.

The prism 131 is preferably constructed as an isoceles triangle having a 90° angle between the first wall 133 and the second wall 134 and 45° angles between the top side 132 and each of the first and second walls 133 and 134, respectively. As will be appreciated, the actual design of the prism 131 depends, in part, on the material from which it is constructed. What is established in the prism 131 is a critical angle where a critical angle is achieved where the coeffecients of refraction between the material in the prism 131 and the fluid (i.e., generally air under ordinary operating conditions) surrounding the prism 131 cause the light to be reflected through the prism 131 first side wall 133 and the second side wall 134.

In this manner, in operation, the sensor 120 will continuously reflect a quantity of light through the prism 131 from the LED 128 to the phototransistor 129. The phototransistor 134 will produce a constant signal of a constant magnitude. However, when liquid covers the first and second walls 133 and 134, respectively, a decreased quantity of light from the LED 128 to the phototransistor 129 will be detected. Such decrease in detectable light is due to the change in the coeeficients of refraction between the material from which the prism 131 is manufactured and the fluid surrounding the prism 131 (i.e., the change from air to gasoline or water) will cause the light to pass through the first side wall 133 of the prism 131 rather than be reflected by the first side wall 133.

When the light from the LED 128 is no longer detected by the phototransistor 129 (or is detected in a reduced quantity), the phototransistor 129 will produce a signal of a reduced magnitude relative to the output under ordinary operating conditions. Accordingly, this change can be utilized as a signal to the controller (FIG. 1; 31) to indicate the presence of leaked liquid at the collection point (FIG. 1; 27) and cause the power to be shut off at the dispenser and pump (FIG. 1; 20 and 23).

Figure 2C:
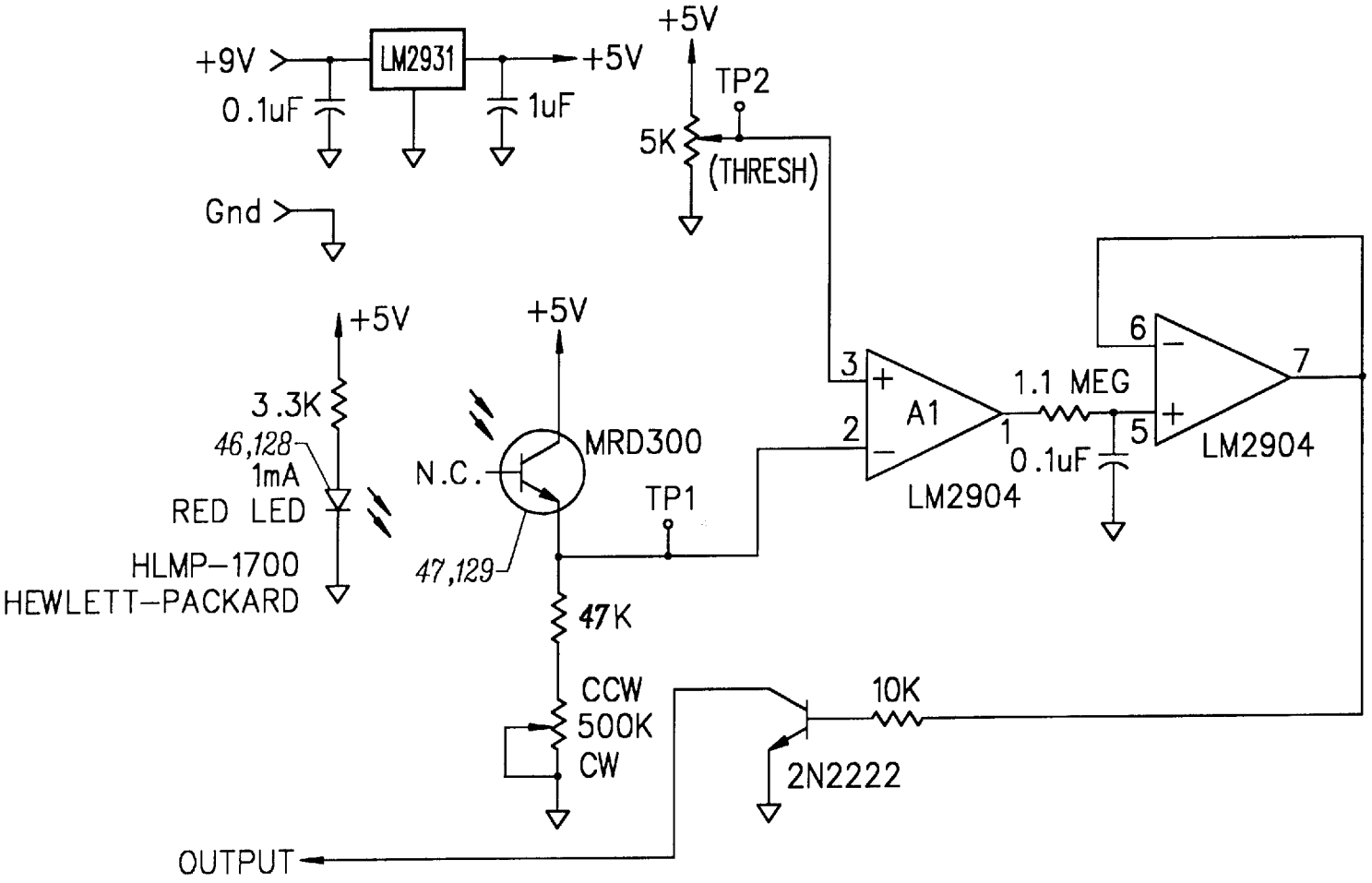

As will be appreciated, such shut off can be accomplished through the use of a variety of simple circuits. For example, in one embodiment, shut off is accomplished through use of the circuit shown in FIG. 2*c*. In this embodiment, it will be appreciated that the LED 46 will be detected by the detector 47. The detector 47 will pass a voltage to an operational amplifier A1. When the path between the LED 46 and the detector 47 is unobstructed (FIG. 2) or where there is full reflectance through the prism 131 (FIG. 2*a*), a threshold voltage as measured at TP2 which is supplied to the operational amplifier A1 is equilibrated with the voltage from the detector 47 as measured at TP1.

As will be appreciated, operational amplifier Al acts as a comparator, wherein, when the voltage at TP1 and TP2 are equal, no signal will be output from operational amplifier A1. However, when the voltage as measured at TP1 is less than the voltage as measured at TP2, a signal will be output by the operational amplifier A1, indicating that the path between the LED 46 and the detector 47 is obscured (FIG. 2) or that the reflectance in the prism 131 is reduced (FIG. 2*a*).

When such a condition occurs, a signal is communicated through the remainder of the circuit which includes a filter F and a buffer A2 to isolate the filter F from a transistor T acting as a voltage gate to output O. The output at O can be used to turn off the power to the pump (FIG. 1; 23) through the controller (FIG. 1; 31).

Figures 3A, 3B:
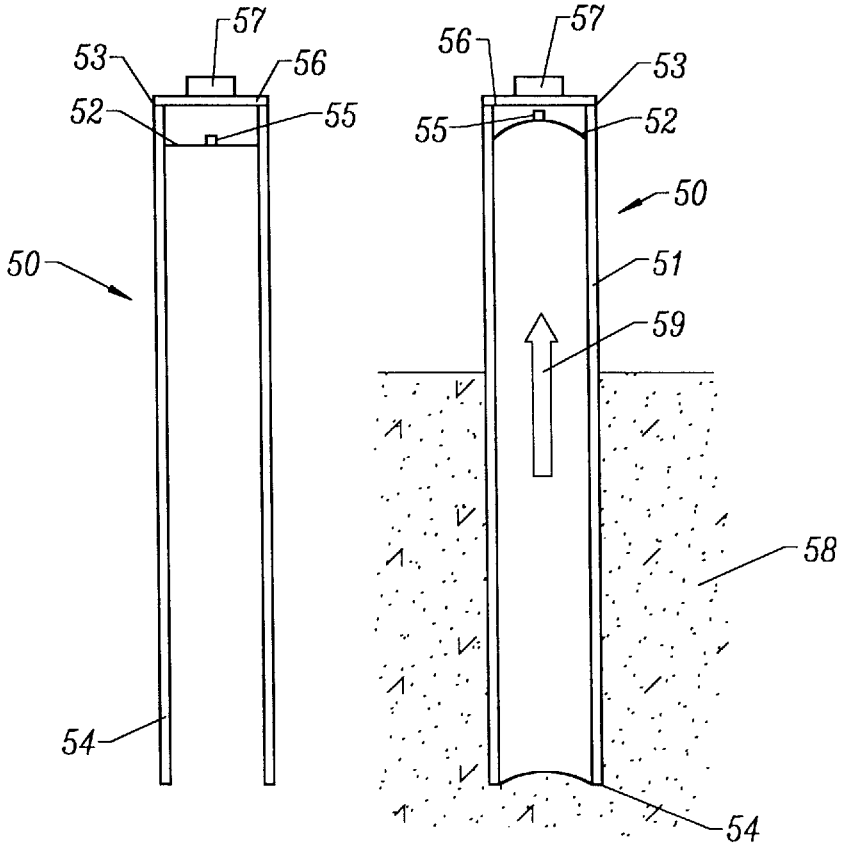
FIGS. 3*a* and 3*b* show the liquid level sensor in operation.

Another design of a liquid level sensor in accordance with the invention is shown in FIGS. 3*a* through 3*b*. There, the liquid level sensor 50 in this embodiment, includes an elongate tube 51 which has a thin, pliable membrane sealingly mounted in the tube 51. The membrane 52 is preferably formed of a material that is insoluble and not destroyed within the environment in which it is placed. For example, in the gasoline application, the membrane is preferably formed from a neoprene type rubber which is relatively indestructible in gasoline. The tube 51 includes an upper end 53 and a lower end 54.

A magnet 55 is mounted on the membrane 52. A cap 56 is sealingly attached to the tube 51. Atop the end piece 56, a magnetic sensor 57 is disposed. In another embodiment, the magnetic sensor 57 is a Hall effect integrated chip or magnetic switch chip. Such chips are sensitive to magnetic fields and can be set to respond to various magnetic fields. Essentially, however, such chips will perform an on-off function at a preset magnetic field level. In this way, the chip may be used to turn off a piece of equipment, such as a pump, upon a predetermined upward deflection of the membrane 52 with the magnet 55 toward the end piece 56 and the magnetic sensor 57. Therefore, the sensor 57 can be used as a switch to turn off power to the pump (FIG. 1; 23) through the controller (FIG. 1; 31).

As will be appreciated, the liquid level sensor 50 is open on its lower end 54. Through inserting the liquid level sensor 50 into a collection point (FIG. 1; 27) in an upright position, the lower end 54 will be in communication with any liquid that fills in at the collection point (FIG. 1; 27). As shown in FIG. 3*b*, the sensor 50 is shown surrounded by a liquid 58. Such liquid 58 forms a column of pressure that will be exerted through the lower end 54 and upon the membrane 52 (as shown by arrow 59). Such pressure, will cause the membrane 52 to be deflected upward causing the magnet 55 to move in proximity to the upper end 53 and the end piece 56 and the sensor 57. The degree of proximity required between the magnet 55 and the sensor 57, can be predetermined by setting the sensitivity of the sensor 57. Accordingly, the amount of liquid that is required to collect at the collecting point (FIG. 1, 27) before the pump will be shut down, can be predetermined.

Figure 4A:
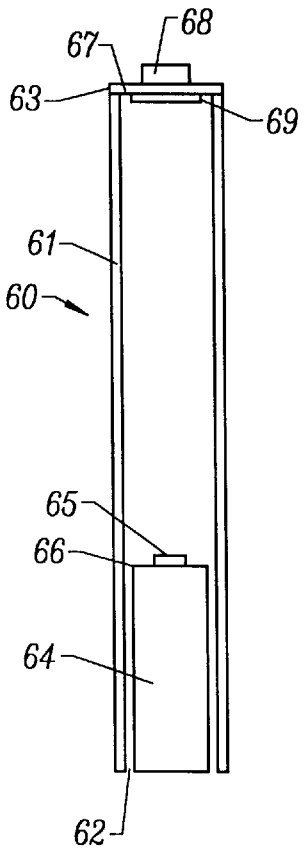
FIGS. 4*a* and 4*b* show the liquid level sensor in operation.
Figure 4B:
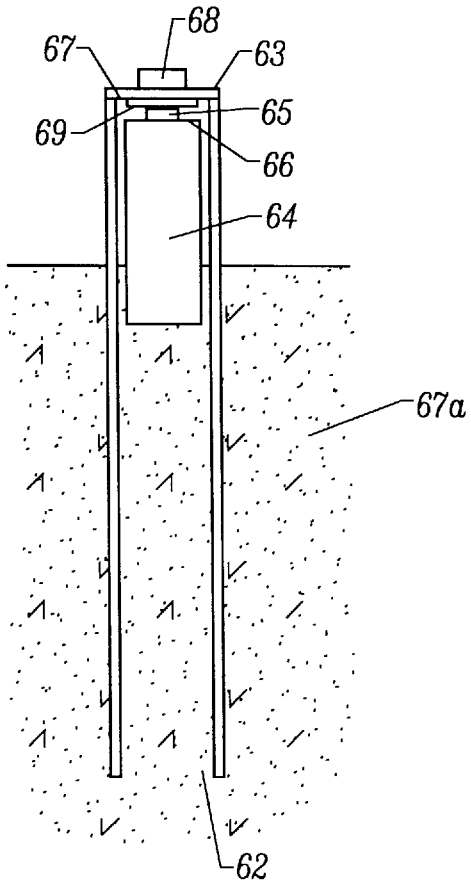

In an alternative embodiment, as shown in FIGS. 4*a* through 4*b*, a liquid level sensor 60 can be prepared from using a hollow tube 61 having an open end 62 and a closed end 63. A float 64 is disposed in the tube 61 and a magnet 65 is affixed on an upper end 66 of the float 64. In another embodiment, the closed end 63 is vented through a vent hole 67 so that as liquid fills outside of the sensor 60, it will be communicated through the inside of the tube 61 allowing the float 64 to move upward toward the closed end 63 (as illustrated in FIG. 4*b*). A magnetic sensor 68 is disposed on or near the closed end 63. The sensor preferably is activated upon the Hall effect, and in certain embodiments is a Hall effect integrated chip or a magnetic switch chip which turns on or off according to the magnetic field experienced by the sensor.

In this embodiment, similarly described above, as a liquid (FIG. 4*b*; 67*a*) collects at the collecting point (FIG. 1; 27) the magnetic sensor 68 will begin to experience a magnetic force from magnet 65 as the magnet is communicated through the tube 61 toward the closed end 63. The distance that the magnet is required to travel prior to causing a full effect on the sensor 68 can be preset. The sensor 68 can be electrically connected to the controller (FIG. 1; 31) and used to shut off the power to the pump (FIG. 1; 23) or cause another effect.

In one embodiment, the closed end 63 of the tube 61 additionally includes a ferrous latching plate 69. The ferrous latching plate allows the magnet 65 on the float 64 to latch in proximity to the magnetic sensor 68. This is useful in situations where a reset is desired because the magnet 65 will bind to the plate 69 until a user moves the magnet 65 away from the plate 69. This can be accomplished, for example, through inserting a probe through the vent hole 67.

In another embodiment of the invention, a liquid level sensor can be prepared such that it will be triggered only in the event that a particular liquid contacts the sensor. In such embodiment, a soluble or erodible material is used to sealingly prevent fluid entry into contact with the sensor. The soluble or erodible material is selected for the particular fluid application. For example, where gasoline or other petrochemicals are desired to be detected, the material can be selected to be soluble or erodible in such fluid. One such material for use in gasoline or many petrochemical applications is styrofoam which will preclude water entry into or contact with the sensor, however, the material will dissolve upon contact with gasoline and many other petrochemicals. In use, the chosen material can be placed over an open end of the sensor to preclude the entry of fluids other than the chosen fluid.

III. MOTION SENSORS

In certain embodiments, the motion sensors of the invention comprise a levitated magnet system in which a first magnet or first system of magnets is used to levitate a second magnet or system of magnets. The first magnet or system of magnets is sometimes referred to herein as the "levitating magnet(s)" and the second magnet or system of magnets that is levitated by the levitating magnets is sometimes referred to herein as the "levitated magnet(s)." Motion of the second magnet or system of magnets (the levitated magnet(s)) is detected relative to the first magnet or system of magnets (the levitating magnet(s)) by a magnetic sensor. The magnetic sensor detects relative movements of the second magnet or magnet system (the levitated magnet(s)).

Figure 5:
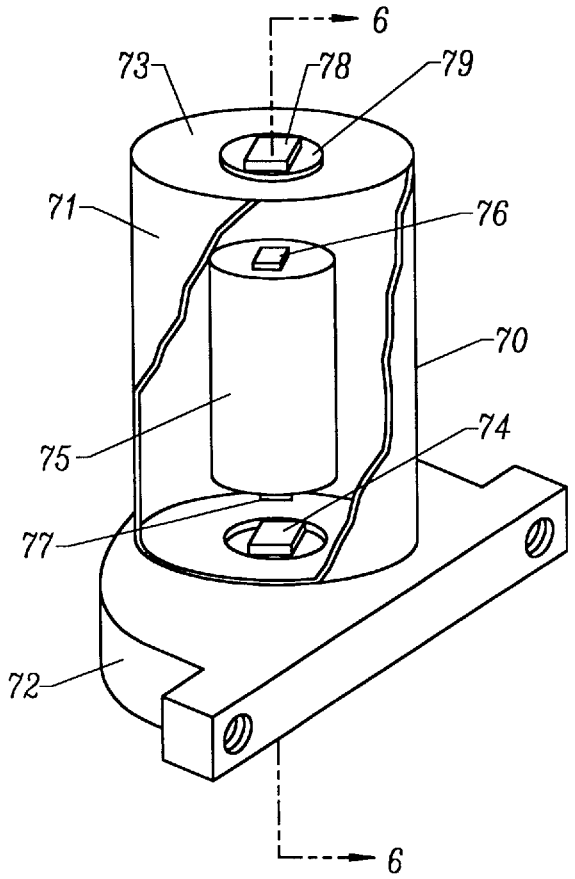
FIG. 5 is a top perspective view of a motion sensor in accordance with the invention.

For example, in another embodiment, a motion sensor is made as shown in FIG. 5 which is a top perspective cut away view of a motion sensor in accordance with the invention. The motion sensor 70 includes a cylindrical housing 71, a base 72 and a top 73. Within the cylindrical housing 71, there is a levitating magnet 74, a magnetic actuator 75 that includes and upper magnet 76 and a lower magnet 77. The lower magnet 77 causes the actuator to levitate through opposite polar effects from the levitating magnet 74. For example, the north pole of the magnet 74 may be placed facing upward and the north pole lower magnet 77 can be faced downward. The upper magnet 76 is in proximity to the top 73 of the housing 71. The top includes a magnetic sensor 78 and a ferrous latch plate 79.

When the sensor 70 is moved in virtually any direction, the levitating force between the levitating magnet 74 and the lower magnet 77 on the actuator 75 is perturbed and the upper magnet 76 is drawn to the latch plate 79 which causes a signal to be generated by the sensor 78.

Figure 6:
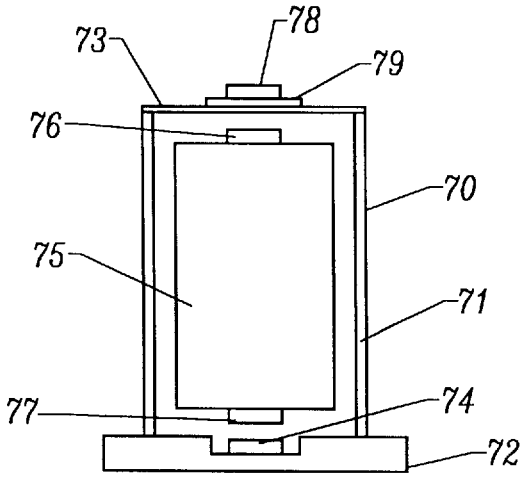
FIG. 6 is a side cross-sectional view of the motion sensor of FIG. 5 taken along line 6—6.

In FIG. 6, there is provided a side cross-sectional view of the sensor and Figure taken along line 6—6. In this view the magnetic actuator 75 can be clearly seen levitated by the levitating magnet 74 which interacts with lower magnet 77. Moreover the relationship between the upper magnet 76, the ferrous latching plate 79, and the magnetic sensor 78 can also be seen. The actuator within the housing 71 is able to freely float in three dimensions. Perturbations due to the movement of the sensor 70, will be monitored by the interaction between the top magnet 76 and the magnetic sensor 78. In another embodiment, however, the sensor 78 is selected so that it produces a signal only when the top magnet 76 latches onto the ferrous latching plate 79.

Figure 7:
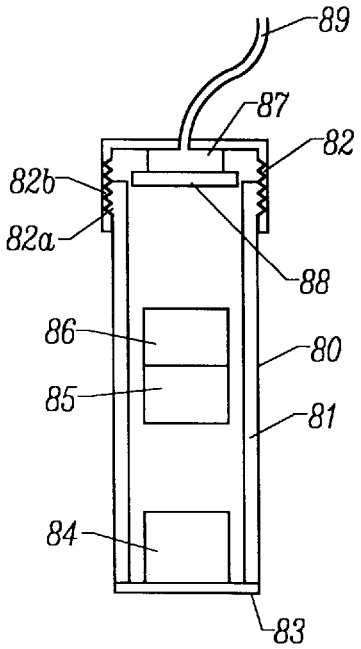
FIG. 7 is a schematic side cross-sectional view of another motion sensor in accordance with the invention.

Another embodiment of the motion sensor of the present invention is shown in FIG. 7 which is a side cross-sectional view of an alternative motion sensor. The motion sensor 80 is a two-piece unit consisting of a lower tubular housing 81 and an end piece section 82. The end piece section 82 is preferably joined to the tubular housing 81 with complementary threads 82*a* and 82*b*. Within the tubular housing 81, at the lower end 83, a permanent magnet such as a sammarian cobalt based magnet 84 is attached adjacent to the lower end 83 of the tubular housing 81.

One or more magnets may be levitated above the permanent magnet 84. For example, the magnets 85 and 86 which are preferably Alnico 8 magnets. Such magnets are levitated by putting the same pole of the magnets 85 and 86 adjacent to the permanent magnet 84. For example, the permanent magnet 84 may have its north pole expose upward and the magnet 85 may have its north pole exposed downward. This will cause a repulsive force between the magnets 84 and 85 and the magnet 85 will be levitated above the magnet 84.

The magnet 86 is preferably bonded to the magnet 85 with its north pole adjacent to the south pole of the magnet 85. This exposes the south pole of the magnet 86 in proximity to the magnetic sensor 87. Adjacent to the magnetic sensor 87, there is a ferrous latching plate 88 to which the magnets 86 and 85 can join. As mentioned above, the end piece 82 is preferably threaded onto the tubular housing 81. This allows the sensitivity of the magnetic sensor 87 which is bonded to the end piece 82 to be varied according to its distance from the levitating magnets 85 and 86.

When the unit is triggered through a force sufficient to attract the south pole of the magnet 86 to the ferrous latching plate 87, the sensor will have a full signal which can be used to control a circuit for example (i.e., turning off the pump (FIG. 1; 23)). In this embodiment, to reset the sensor after the magnet 86 has latched to the ferrous latching plate 87, a user simply unscrews the end piece 82 from the tubular housing 81 and resuspends the magnets 85 and 86 above the permanent magnet 84 and rescrews the end piece 82 back into position on the tubular housing 81.

Figure 8:
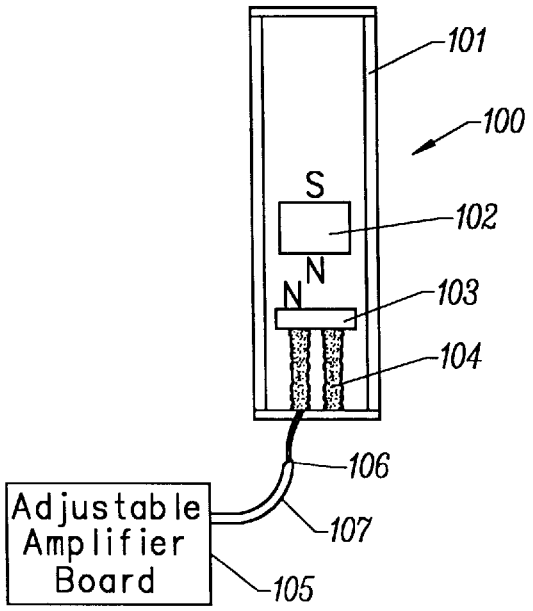
FIG. 8 is a schematic side cross-sectional view of another motion sensor in accordance with the invention.

In another embodiment as shown in FIG. 8, which is a side cross-sectional view of a motion sensor of the present invention, which is a high sensitivity low power levitated magnet vibration sensor. In this embodiment, there is the motion sensor 100 has a tubular housing 101, that is preferably closed on both ends. A magnet 102 (such as an Alnico 8 magnet) is suspended above a second magnet 103 (again, such as an Alnico 8 magnet). As described above, suspension, or levitation, is achieved by positioning the poles of the magnets 102 and 103 so that they will repel, i.e., as indicated in the Figure north to north.

The second magnet 103 is bonded to an inductive coil or a magnetoresistive element 104 which will produce a voltage in response to changing magnetic field. In this embodiment, therefore, the sensor signal is self-generating (generated by the magneto resistive element 104) and power consumption is virtually nonexistent. The inductive coil 104 communicates in one embodiment with an adjustable amplifier board 105 through leads 106 and 107.

Such sensor can be used for monitoring very low vibrations that would be experienced by any given piece of equipment. Through the use of the adjustable amplifier board 105, the amount of vibration required to achieve an effect can be adjusted. Thus, it is possible to preset the amplifier board 105 the amount of either up-down, side-to-side, or tilting motion that is required to turn off power to a pump (FIG. 1; 23), as described above.

Figure 9:
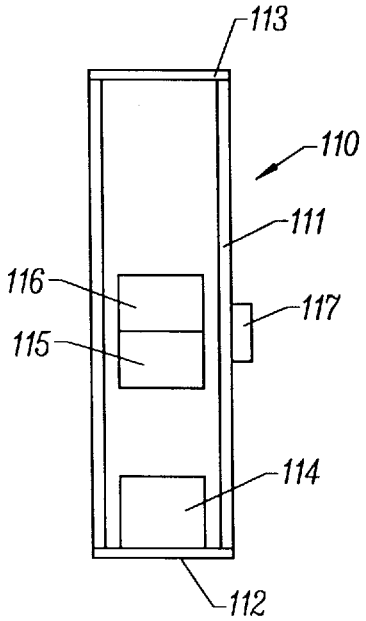
FIG. 9 is a schematic side cross-sectional view of another motion sensor in accordance with the invention.

In another embodiment, shown in FIG. 9 which is a side cross-sectional view of an alternative motion sensor in accordance with the invention, a system for measuring particularly vertical vibration is shown. The sensor 110 has a tubular housing 111 and a base 112 and a top 113. A permanent magnet (such as a sammarian cobalt base magnet with a gauss level of 2.86 kilograms) 114 which is preferably mounted in the bottom in the base section 112. Above this as described in connection with FIG. 7, one or more magnets may be levitated. Here, magnets 115 and 116 (which in a preferred embodiment are Alnico magnets) are levitated above the permanent magnet 114.

As indicated above, levitation is accomplished by placing the similar poles of magnet 115 and 114 in proximity to one another. A magnetic sensor 117 is placed on an outer wall 118 of the tubular housing 111. The magnetic sensor is preferably a Hall effect sensor, or other similar sensor which can be used to measure the change in magnetic field exhibited by the magnets 115 and 116 in vibration. It will be appreciated, that in vertical vibration the magnets 115 and 116 will move up and down (i.e., away from and towards and vice versa) the top end 113 and the bottom end 112. The associated change in magnetic field detected by magnetic sensor 117 can be used to monitor the vibration.

Figure 10:
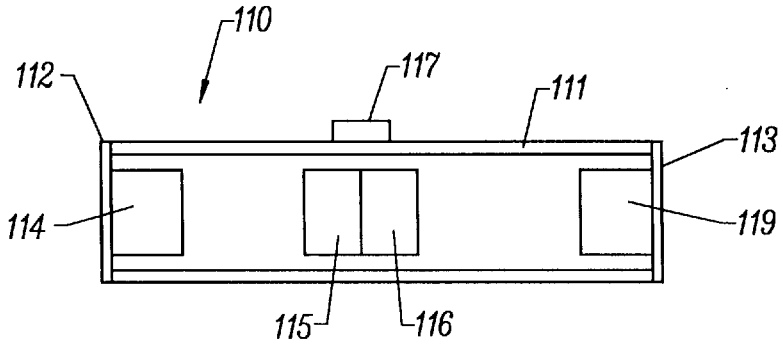
FIG. 10 is a schematic side cross-sectional view of another motion sensor in accordance with the invention.

In another embodiment as shown in FIG. 10, there is provided a cross-sectional view of another motion sensor of the present invention that is useful for measuring lateral vibration. This design is virtually identical to the design shown in FIG. 9, however, an additional permanent magnet (such as a Sammarian cobalt magnetic) is disposed in what was the top end 113 of the sensor shown in FIG. 9. In this embodiment, the poles of magnets 114 and 119 are positioned so that they are the same as the facing poles on magnets 115 and 116, respectively. The magnets 115 and 116 are therefore levitated from both ends by magnets 114 and 119. When the sensor is laid on its side as is shown in FIG. 10, the magnetic sensor 117 will strongly detect lateral vibration of the motion sensor 110.

Figure 11:
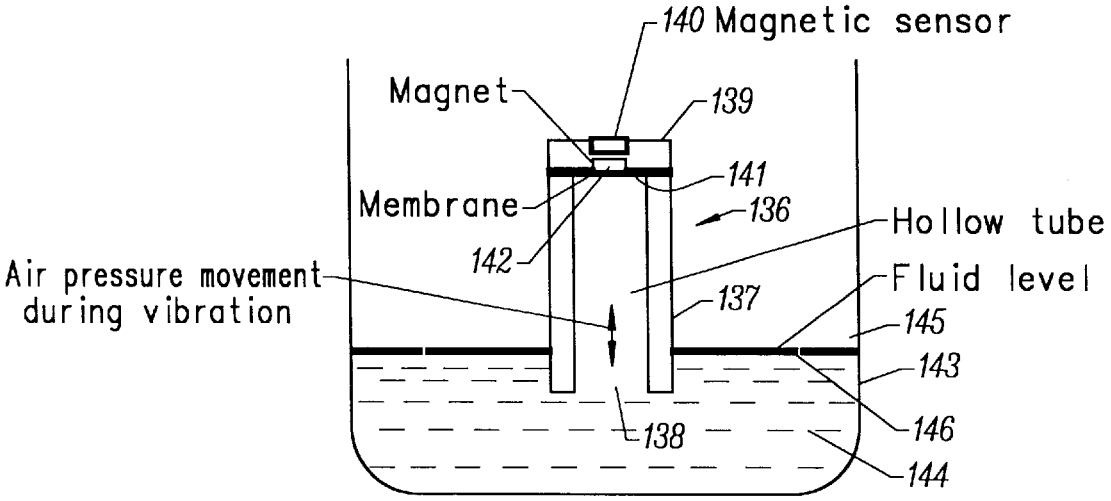
FIG. 11 is a schematic side cross-sectional view of another motion sensor in accordance with the invention.

In another embodiment of the motion sensor of the invention, there is provided a sensor based on changes in hydrostatic pressure. This embodiment is shown in FIG. 11. The sensor 136 includes a first housing 137 having a bottom open end 138 and a top closed end 139. A magnetic sensor 140 is mounted on the top end 139. A membrane 141 is disposed within the housing 137 having a magnet 142 bonded thereto. In general, the magnet 142 on the membrane 141 is located in proximity to the magnetic sensor 140 on the top end 139.

The sensor 136 is mounted within a second housing 143 that contains a liquid 144 and a gas 145. The bottom open end 138 of the sensor 136 is positioned so that it is just below the liquid/gas interface 146 in the second housing 143.

In operation, when the sensor system 136 is vibrated or moved, there will occur air pressure fluctuations in the first housing 137 which will cause the magnet 142 on the membrane 141 to move in relation to the magnetic sensor 140 on the top end 139. Such movements can be used to cause the magnetic sensor 140 to produce a signal corresponding to the movement of the magnet 142.

It will be appreciated that the motion sensors of the invention have a variety of advantages. For example, they are very low cost, small in size, and low in complexity. Their low complexity ensures a very high reliability. Moreover, in addition to the above advantages, the sensors are very low power consumption and are suitable for long term battery powered operation.

In addition to their utility in gasoline pump power shutoff as described above, the motion senors of the invention are highly useful in a variety of other applications. For example, arrays of such sensors may be used to monitor various segments of transportation infrastructures, such as bridges, railways, etc. They are also useful in multipoint monitoring of manufacturing machinery, for example, bearing wear. Further, the sensors are useful in suspension monitoring in automobiles, trucks, trailers, and railcars. They may also have utility in inexpensive geophone arrays for geological studies and large array resource exploration such as undersea oil filed exploration. Finally, such sensors are highly useful in the manufacture of earthquake sensors for utilization in consumer applications. For example, the sensors of the invention may be used to shut off gas or electricity to houses which are affected by earthquakes of a given magnitude. Or, alternatively, they may sound an alarm in the event of an earthquake so that consumers may take appropriate precautions.

As will also be appreciated, the motion sensor may include an electromagnet as the levitating magnet. The only advantages to the use of a permanent magnet as the levitating magnet is that there is no separate power supply required to cause the leviation. This simplifies the system and makes it far less expensive to manufacture.

IV. POWER SENSORS

As was discussed above, another aspect of the present invention is the use of power sensors for the remote monitoring of whether a sensor has triggered. In one embodiment, as shown in FIG. 8, an amp probe is used. In this embodiment, the amp probe is essentially an inductive coil wrapped around a power line. The inductive coil will generate a voltage when power is flowing through the line. Through varying the coil size and through use of circuitry associated therewith, it is possible to detect very low voltages or voltage changes. Thus, as discussed above, in pumping applications, where it is desired to shut off the pump in response to a given environmental effect (such as the accumulation of liquid below a pump or in response to a impact of a given magnitude) the power sensors of the invention can be used in combination with a pump shutoff system and are very effective at detecting the voltage drop due to the shutoff.

The power sensors of the invention can be interrelated with circuitry for sounding an alarm in the event of a voltage drop. Whatever the cause of the voltage drop (accumulation of liquid, motion, or merely power failure or pump failure) it is important for an operator to be aware of the same so that the operator can take appropriate preventive measures. The alarm can either be a visual or an audible alarm or even a combination.

Figure 12:
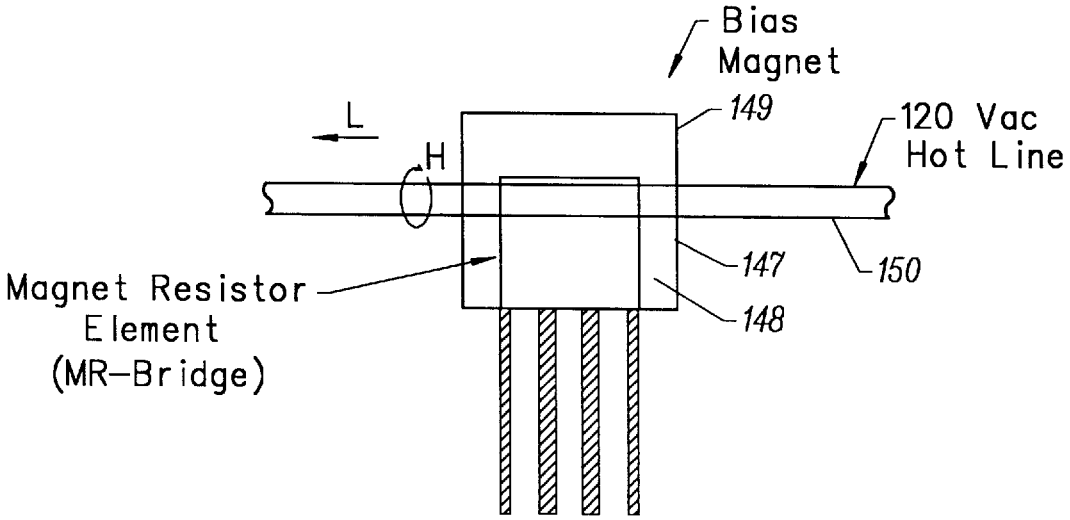
FIG. 12 is a schematic represenation of a power sensor in accordance with the invention.

A preferred power sensor in accordance with the invention is shown in FIG. 12. In this embodiment, the sensor 147 includes a magnetoresistive sensor 148 (i.e., an AMR or GMR sensor) and an associated biasing magnet 149. The sensor 147 is placed in proximity to an electrical line 150 having a current (L) flowing therethrough. As will be appreciated, the current (L) generates a magnetic field (H) around the diameter of the line 150. Accordingly, the sensor can detect changes in the current (L) induced magnetic field (H). The biasing magnet 149 assists in stabilizing the magnetoresistive sensor 148 and prevents flipping.

Figure 13:
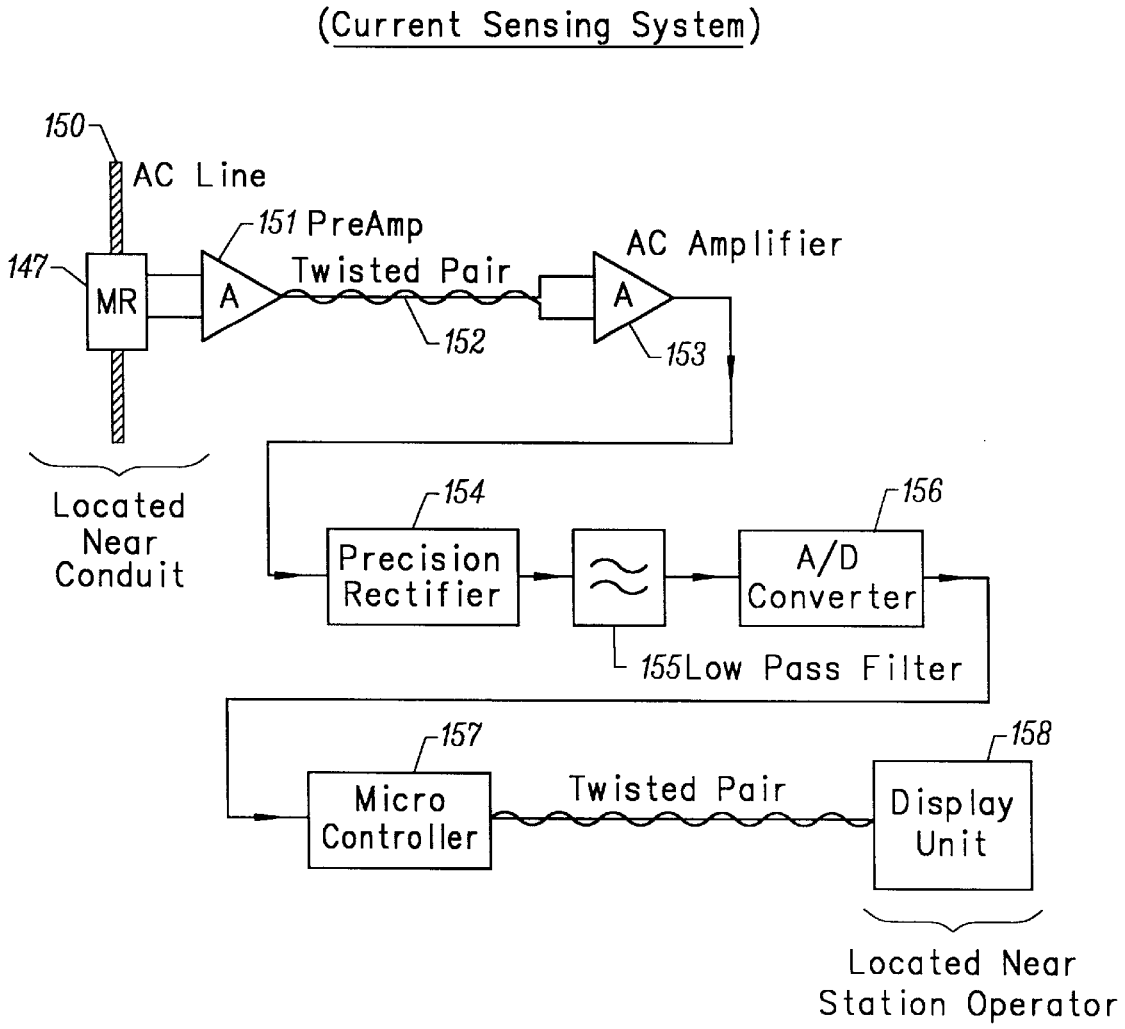
FIG. 13 is a block schematic of a power sensor in accordance with the present invention in association with electrical circuitry to drive a display or an alarm.

As shown in FIG. 13, the sensor 147 may be coupled with circuitry to detect changes in current (L) through the line (FIG. 12; 150). In this embodiment, the sensor 147 outputs to a preamplifier 151 and the amplified signal is communicated through a twisted pair cable 152 to an a/c amplifier 153. The signal is preferably rectified by a precision rectifier 154, filtered with a low pass filter 155, and converted from analog to digital with an analog to digital converter 156. The digital signal is communicated to a microcontroller 157 which may be communicated through a twisted pair cable to a display or alarm unit 158. The display or alarm unit 158 is preferably located near the station operator.

In general, with this arrangement, continuous information about the flow of current (L) through line 150 is provided to the microcontroller 157. Preferably, however, the microcontroller 157 is used to select particular current characteristics required to display or sound an alarm at the display or alarm unit 158. For example, in a preferred embodiment, the display or alarm unit 158 is only triggered in the event that the current detected at the microcontroller is less than a predetermined value.

In gasoline pumps applications, the pumps generally have a resting voltage that is drawn regardless of whether there is any activity at the pump. In many instances, this resting voltage is approximately 0.75 volts. The microcontroller 157 can be programmed to cause a display or alarm at the display or alarm unit 158 if the voltage falls below such resting voltage, i.e., if the power to the pump has been shut down, for example, owing to a detection of liquid in a liquid level sensor or the detection of movement in a motion sensor.

EQUIVALENTS

The present invention has been described in terms of certain preferred embodiments and represents the best mode contemplated. However, it will be understood that the scope of the present invention is to be interpreted according to the appended Claims and any equivalents thereof.

What we claim is:

1. A system, comprising:

a gasoline dispenser for pumping gasoline to a vehicle, the gasoline dispenser including a housing containing electrical components;

an electrical power supply line providing power to the electrical components in the gasoline dispenser;

a motion sensor that is mechanically attached to the gasoline dispenser housing, the motion sensor having an output producing a first electrical signal upon detecting a predetermined quantity of motion of the gasoline dispenser housing; and a controller connected to the output of the motion sensor and the electrical power supply line, the controller when receiving the first signal causing power to substantially stop flowing in the electrical power supply line.

2. The system of claim 1, wherein the motion sensor comprises a housing having a first end and a second end with a levitating magnet disposed at the first end and a magnetic sensor disposed at the second end and having a levitated magnet disposed therebetween, wherein, upon a predetermined quantity of motion of the gasoline dispenser housing, the levitated magnet moves in relation to the magnetic sensor and produces the first signal.

3. The system of claim 2, wherein the motion sensor further comprises a ferrous latching plate disposed at the second end and wherein when the levitated magnet moves in proximity to the magnetic sensor the levitated magnet latches to the latching plate.

4. The system of claim 1, further comprising:

a receptacle positioned at a base of the gasoline dispenser housing for collecting gasoline spilled in the dispenser; and a liquid level sensor disposed in a base of the receptacle, the liquid level sensor being designed to produce a second electrical signal upon the detection of a predetermined quantity of the spilled gasoline, wherein the controller is further connected to the liquid level sensor, the controller when receiving the second signal causing power to substantially stop flowing in the electrical power supply line.

5. The system of claim 4, wherein the liquid level sensor comprises a housing having a wall, an open end, and a closed end defining a chamber, the chamber having a flexible membrane bound therein in proximity to the closed end, the membrane having a magnet bound thereto, the closed end having a magnetic sensor bound thereto, wherein when the quantity of the liquid chemical is collected the liquid chemical is communicated against the open end and forms a head of pressure within the chamber pressing against the membrane and causing the membrane to be flexed toward the closed end which causes the magnet to be moved in closer proximity to the sensor thereby producing the second signal.

6. The system of claim 4, wherein the liquid level sensor comprises a housing having a wall, an open end, and a substantially closed end defining a chamber, the chamber having a float disposed therein, the float having a top end and a bottom end and a magnet bound to the top end, the closed end having a magnetic sensor bound thereto, wherein when the quantity of the liquid chemical is collected the liquid chemical is communicated into the open end causing the float to be moved toward the closed end which causes the magnet to be moved in proximity to the sensor thereby producing the second signal.

* * * * *